United States Patent [19]

Hagood et al.

[11] 4,352,039

[45] Sep. 28, 1982

[54] SONIC TRANSDUCER

[75] Inventors: Jerry W. Hagood; Ralph L. Norman, both of Huntsville, Ala.

[73] Assignee: The United States of America as represented by the Secretary of the Army, Washington, D.C.

[21] Appl. No.: 172,360

[22] Filed: Jul. 25, 1980

[51] Int. Cl.[3] ..... H04R 19/00

[52] U.S. Cl. ..... 310/328; 179/111 R; 181/150

[58] Field of Search ..... 310/334, 326, 328; 179/110 A, 181 R, 181 W, 1.5 M, 111 R; 181/150

[56] References Cited

U.S. PATENT DOCUMENTS

| | | | |
|---|---|---|---|
| 2,341,275 | 2/1944 | Holland | 179/181 W |
| 2,796,467 | 6/1957 | Kock | 179/111 R |
| 3,311,712 | 3/1967 | Cain | 179/181 W |
| 4,048,454 | 9/1977 | Barcus et al. | 179/110 A |
| 4,098,370 | 7/1978 | McGregor et al. | 179/1.5 M |

*Primary Examiner*—A. T. Grimley
*Assistant Examiner*—D. L. Rebsch
*Attorney, Agent, or Firm*—Nathan Edelberg; Robert P. Gibson; James T. Deaton

[57] ABSTRACT

A sonic transducer device for vibrating windows and glass partitions in the human ear sensitivity range to prevent the capture of conversation by placing an interfering vibration on the windows or glass partitions.

1 Claim, 6 Drawing Figures

SONIC TRANSDUCER

DEDICATORY CLAUSE

The invention described herein may be manufactured, used, and licensed by or for the Government for governmental purposes without the payment to us of any royalties thereon.

BACKGROUND OF THE INVENTION

Conversation in a room with large glass windows causes the windows to vibrate in resonance with the conversation. It is said that radar and other listening devices have reached a developmental level from which they can detect the window vibrations and translate them to spoken words. This obviously presents a security problem of major magnitude. In view of these conditions, there is a need for a device which will prevent conversations from being picked up from vibrating windows in order to prevent any possible security leaks.

Therefore, it is an object of this invention to provide a sonic transducer which imparts vibration to a window or glass partition to prevent one from being able to pick up conversations from vibration of the windows or glass partitions.

Another object of this invention is to prevent the capture of conversation from a glass or window by placing an interfering vibration on the glass or window.

Other objects and advantages of this invention will be obvious to those skilled in this art.

SUMMARY OF THE INVENTION

In accordance with this invention, sonic transducer devices are provided that include either a window pane closure as a portion thereof or means for connection to a window pane to vibrate the window pane at such a frequency as to prevent one from being able to monitor the vibration movement of the pane and translate from the vibration the spoken words that are being spoken within a room.

DESCRIPTION OF THE PREFERRED EMBODIMENTS

Several embodiments of a transducer device are disclosed which place and maintain a sonic vibration in sheet glass commonly used for windows and partitions. This sonic vibration is music, singing, speech and/or noise. The sonic vibration generally is of an energy level (magnitude) slightly exceeding the vibrations induced by conversations, music, tape players, sound movies, etc. in the immediate surrounding areas.

Figure 1:
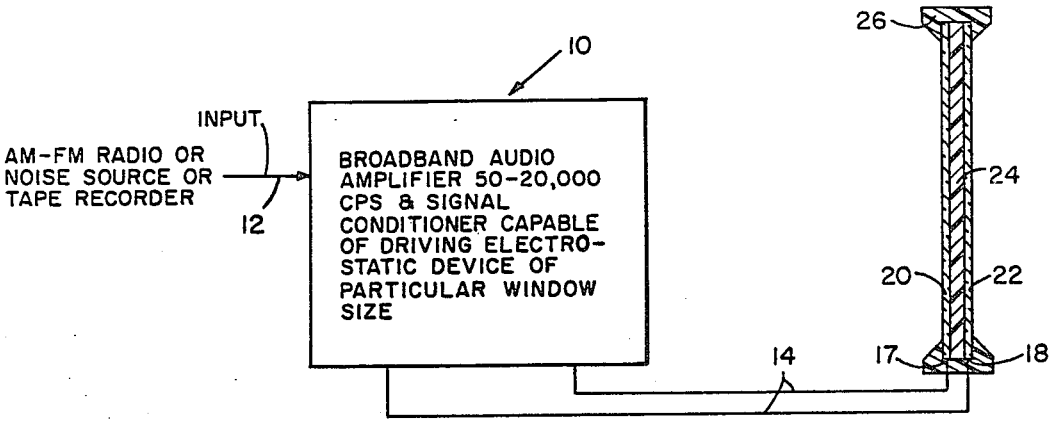
FIG. 1 is a schematic plan view of a sonic transducer device in accordance with this invention.

Referring now to FIG. 1, in this configuration the sonic transducer device includes a broad band amplifier 10 which operates from about 50 to about 20,000 cycles per second and has a signal conditioner capable of driving an electrostatic device of the particular window size that is to be vibrated. Broad band audio amplifier 10 has its own built-in power supply that is fed by either direct current or by an ac line. Broad band audio amplifier 10 has an input 12 which is designed to receive an AM-FM radio, noise source, or tape recorder source for the broad band amplifier to amplify and produce output signals at leads 14. Leads 14 are conductively attached in a conventional manner at 17 and 18 such as by conductive adhesive to two electrically conductive glass sheets 20 and 22. Glass sheets 20 and 22 have an elastic, insulative layer 24 therebetween and sheets 20 and 22 are mounted with an insulated housing 26 therearound for supporting glass sheets 20 and 22 with the elastic, insulative layer 24 therebetween.

When the appropriate signal is applied at input 12 to broad band amplifier 10, an output is produced at leads 14 and applied to glass sheets 20 and 22 to induce vibration in sheets 20 and 22 with a magnitude greater than the magnitude with which these sheets vibrate from the human voice in the immediate surroundings. With these interfering vibrations on sheets 20 and 22, efficient interference is produced. That is, sufficient vibration interference is placed on glass sheets 20 and 22 to prevent the translation of the spoken word from being detected and picked off due to vibrations of sheets 20 and 22. An incidental advantage of this embodiment is appreciated due to the window being thermally insulated beyond the normal window pane. That is, elastic and thermal insulation 24 produces the additional advantage of a window of this type as opposed to a single window pane or sheet.

Figure 3:
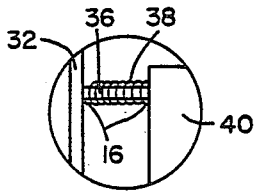
FIG. 3 is a schematic illustration of a magento-strictive device that can be used in the transducer device of FIG. 2.
Figure 4:
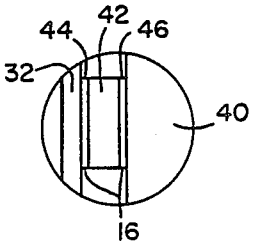
FIG. 4 is a schematic illustration of a piezoelectric transducer that can be used in the transducer device of FIG. 2.
Figure 2:
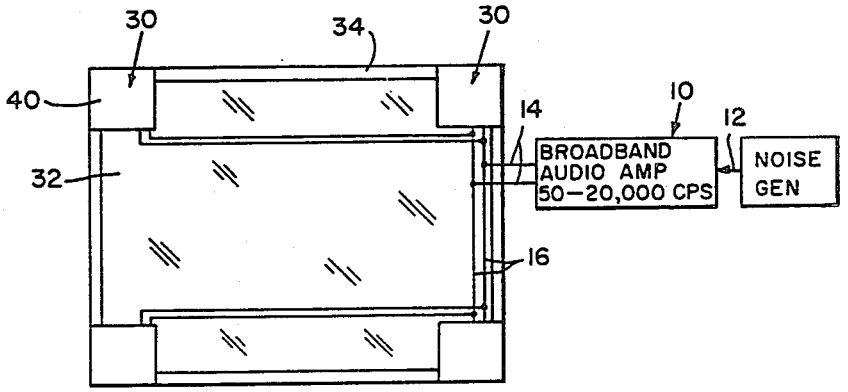
FIG. 2 is a schematic view of another transducer device in accordance with this invention.

Referring now to FIGS. 2 through 4, other arrangements are disclosed which include a broad band amplifier 10 which is the same or similar to that disclosed in FIG. 1 which has an input 12 with a signal from a noise generator the signal being the same or equivalent to those disclosed for that of FIG. 1. Broad band amplifier 10 has leads 14 at the output thereof that are connected to leads 16 which are connected for driving one or more transducers 30 which are connected to window pane 32 and frame 34 in which pane 32 is mounted. As illustrated, pane 32 has four transducers 30. The number of transducers 30 used to vibrate window pane 32 will depend upon the particular size of window pane 32. As illustrated, there is a transducer 30 at each corner that is used to produce an interfering vibration on window pane 32. Transducer 30 can take a form as illustrated in FIG. 3 and include a magneto-strictive device having an armature 36 attached in a conventional manner such as by adhesive to window pane 32 and with a coil 38 supported by support structure 40 which interconnects the transducer to window frame 34. Coil 38 is connected with leads 16 for driving the transducer. In FIG. 4 a similar transducer is disclosed that includes piezoelectric material 42 that has electrical contacts 44 and 46 are connected to leads 16. Electrical contacts 44 and 46 are connected to window pane 32 and support structure 40 by being bonded or otherwise secured in a conventional manner.

In each of these arrangements, when an input is presented at 12 to broad band amplifier 10, an output is presented at leads 14 and 16 and applied to transducer or transducers 30 to drive the transducer and cause window pane 32 to vibrate. With a transducer as illustrated in FIG. 3, the potential across coil 38 causes the magneto-strictive device to impart vibrating movement to pane 32 and in the piezoelectric device of FIG. 4, application of the potential across leads 16 and piezoelectric material 42 causes window pane 32 to vibrate as piezoelectric material 42 vibrates. Therefore, it can be seen that interfering vibrations are placed on window pane 32 to prevent desired intelligence from being taken from the vibrating window pane. In each of these arrangements, the output produced at leads 14 is properly matched to the characteristics of the particular transducer and the size of the window pane to which the transducer is attached.

Figure 5:
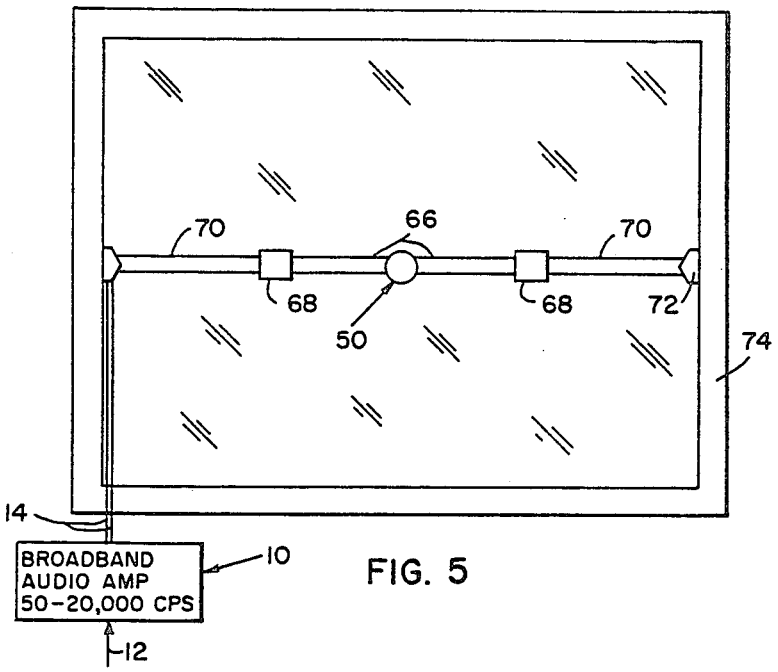
FIG. 5 is a schematic view of still another transducer device in accordance with this invention.
Figure 6:
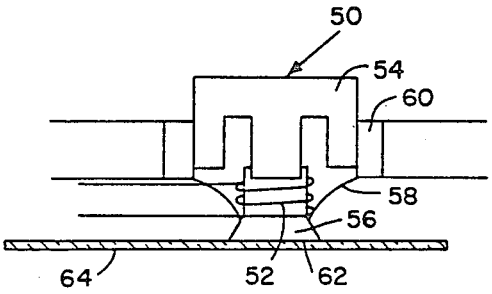
FIG. 6 is an electromagnetic device that can be used in the arrangement of FIG. 5 to impart vibration to a window pane.

Referring now to FIGS. 5 and 6, another sonic transducer device is disclosed which include an input 12 which is similar or the same as that disclosed for FIG. 1 that is input to a broad band amplifier 10 with leads 14 that are connected to coil 52 (see FIG. 6) of electromagnetic transducer 50. Electromagnetic transducer 50 includes permanent magnet 54, armature 56 about which coil 52 is mounted and flexible mount 58 which interconnects armature 56 to mounting means 60 that is secured to permanent magnet 54. Armature 56 has an endface 62 that is adapted to be placed against one surface of window pane 64. If desired, face 62 can be cemented to glass 64 to make a more permanent installation. Support 60 also includes arms 66 that have adjustable joints 68 and outer arms 70 with base supports 72 for securing the transducer to window frame 74. Window pane 64 is mounted in frame 74 in a conventional manner. As can be seen, in this arrangement the device can be used as a portable device for outfitting a room for a particular conference for a limited period of time or it can be installed as a permanent installation to a conventional window frame with a conventional window pane therein. Therefore, it can be seen that an ordinary window with a regular frame and glass therein can be converted to a sonic secured window by using the device disclosed in FIGS. 5 and 6. It is also pointed out that cementing of face 62 to window pane 64 provides a slight performance improvement over just placing face 62 in contact with window pane 64.

In operation, with the sonic transducer mounted in a window and with face 62 against window pane 64, application of the desired signal to input 12 of broad band amplifier 10 causes the desired signal to be produced at leads 14 and applied to coil 52 to cause armature 56 to move relative to permanent magnet 54 in accordance with the signal applied across coil 52 and thereby cause window pane 64 to vibrate and place an interfering vibration on window pane 64 to prevent one from being able to pick up conversations being conducted in a room to which window pane 64 is a portion thereof. Therefore, it can be seen that this device also enables one to safe a room from conversation being pickedoff at a window thereof.

We claim:

1. A sonic transducer device comprising a broad band amplifier having an input which is fed sonic vibration signals selected from those produced from music, singing, speech and/or noise, said broad band amplifier producing an output which is fed through output leads to an electrical transducer which produces vibrations in a window pane to put an interfering vibrating frequency on the window pane to prevent one from detecting vibrations of the window pane that can be translated into spoken words that are being spoken within a room where the window pane is mounted, said electrical transducer including a pair of electrically conductive sheets of glass that form said window pane and are mounted in an insulated housing with an elastic, transparent, insulative layer between the glass sheets, and said output leads from said broad band amplifier being electrically connected to said glass sheets to cause said glass sheets to vibrate when an output is produced at the output leads.

* * * * *